United States Patent [19]

Miller

[11] 4,084,145

[45] Apr. 11, 1978

[54] CURRENT LIMITING FUSE WITH IMPROVED SPACING BETWEEN PARALLEL ELEMENTS

[75] Inventor: Harold L. Miller, West Elizabeth, Pa.

[73] Assignee: Westinghouse Electric Corporation, Pittsburgh, Pa.

[21] Appl. No.: 391,919

[22] Filed: Aug. 27, 1973

[51] Int. Cl.[2] ..... H01H 85/16

[52] U.S. Cl. ..... 337/231

[58] Field of Search ..... 337/161, 163, 231, 232, 337/233, 293

[56] References Cited

U.S. PATENT DOCUMENTS

| | | | |
|---|---|---|---|
| 2,439,674 | 4/1948 | Schuck | 337/231 X |
| 3,400,235 | 9/1968 | Howard et al. | 337/238 |

FOREIGN PATENT DOCUMENTS

| | | | |
|---|---|---|---|
| 864,943 | 5/1941 | France | 337/29 B |
| 106,809 | 6/1937 | Sweden | 337/231 |

*Primary Examiner*—J. V. Truhe
*Assistant Examiner*—Fred E. Bell
*Attorney, Agent, or Firm*—M. J. Moran

[57] ABSTRACT

An electrical current limiting fuse having longitudinally spaced support members for fuse elements. The support members comprise a central portion having radial arms supported thereon. Coiled fuse elements are disposed between complementary radial arms of the longitudinally spaced support members. The fuse elements are not coiled around each support member as a whole to completely peripherally encompass it but merely are held at one position on the periphery.

2 Claims, 14 Drawing Figures

FIG. 1
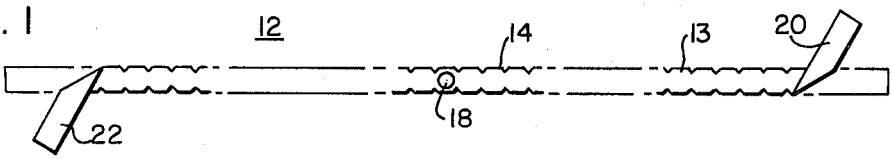
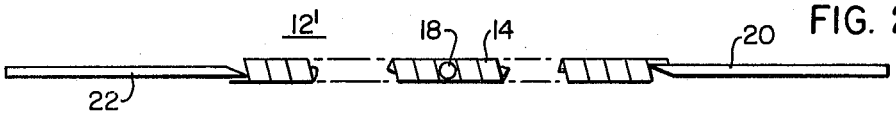
FIG. 2
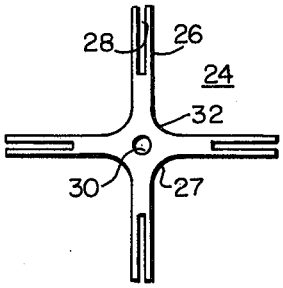
FIG. 3
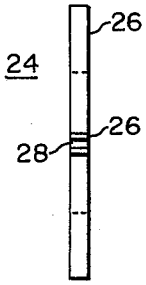
FIG. 4
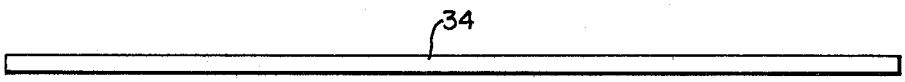
FIG. 5
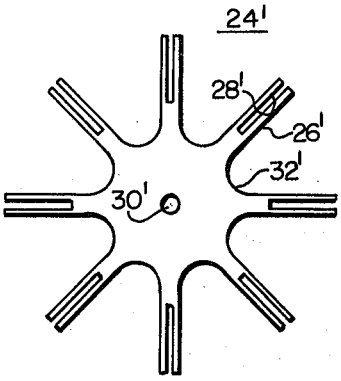
FIG. 6
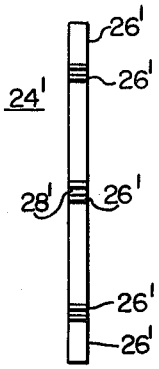
FIG. 7

CURRENT LIMITING FUSE WITH IMPROVED SPACING BETWEEN PARALLEL ELEMENTS

BACKGROUND OF THE INVENTION

1. Field of the Invention:

This invention relates to electrical fuses in general, and it has particular relationship to current limiting fuses of the type having internal support members for supporting wound or coiled fuse elements.

2. Description of the Prior Art:

It is known in the prior art that fuse elements of the current limiting type are often coiled or wound upon a mandrel or spider which is internal to the hollow insulating tubular body of a current limiting fuse. The coils are wound on the mandrel so that the effective overall length of the fuse body may be shortened while the overall length of the fuse element remains significantly long when compared with the overall length of the fuse itself. The reason for this lies in the fact that in certain current limiting fuse operations, it is necessary to strike multiple electrical arcs in series along a fuse element during the fusing operation. It can easily be seen from this that the longer the fuse element is, the more electrical arcs may be struck during the fusing operation. In certain current limiting operations, it happens that the fuse body would be prohibitively long if the unwound fuel element was strung between the contacts or ferrules of a standard fuse in a straight line. However, if the fuse body is shortened to a convenient size, the fuse element may be made into the form of a helix or spring-like object which can be easily contained between the electrical ferrules of a fuse of convenient longitudinal size. Often, for high rated current fuses, it is necessary to provide multiple fuse elements of a given length in parallel to accommodate all of the possible current that may flow in the fuse. By reference to U.S. Pat. No. 3,243,552 issued on Mar. 29, 1966 to H. W. Mikulecky and U.S. Pat. No. 2,157,907 issued May 9, 1939 to K. A. Lohausen, it can be seen that a central mandrel or spider can be used to accommodate the parallel elongated coiled fuse elements. One of the problems that this construction presents is the relative close spacing between parallel fuse elements along the entire length of the fuse helix. This leads to arcing between fuse elements or short circuiting between fuse elements during a fusing operation and the severe problem of fuse element-to-tube voltage breakdown. Either of these characteristics is undesirable for current limiting fuses. It would, therefore, be advantageous if an electrical current limiting fuse could be provided of convenient overall length which had as a part thereof single or parallel fuse elements disposed between the end ferrules thereof which were helical in form so as to provide a sufficient length of fuse element in each case to provide the desired arc limiting effect, but which, nevertheless, were sufficiently spaced from one another in the fuse structure to prevent arc-over between fuse elements of flashover between fuse elements or short circuiting between fuse elements during the fusing operation.

SUMMARY OF THE INVENTION

In accordance with the invention, an electrical current limiting fuse is provided comprising a tubular cylindrical fuse housing of glass polyester or melamine material which is electrically insulating, where the previously mentioned housing is capped at either end with an electrically conducting ferrule to which an external electric circuit and load may be connected. Internal to the housing of the fuse element, a fuse core consisting of a series of glass polyester pinwheel-type wafers cemented on a small diameter support rod and spaced longitudinally along the support rod is provided. At the end of each or any pinwheel arm or radial arm is a slit in which a portion of a pre-wound fuse helix or spiral is disposed. Complementary arms of each pinwheel along the support rod hold or support portions of an elongated spiraled fuse element. The helically or spiral shaped fuse elements are not wound peripherally around the support member but rather are suspended or supported only by one arm on each member. In that way, a parallel fuse element of the same kind may be supported by another set of complementary arms along the length of the fuse while being maintained at a relatively large spaced distance from the previously mentioned spiraled fuse element.

BRIEF DESCRIPTION OF THE DRAWINGS

For a better understanding of the invention, reference may be had to the preferred embodiments exemplary of the invention shown in the accompanying drawings, in which:

FIG. 1 shows a current limiting fuse element before winding with the ends thereof turned up for convenient alignment after winding;

FIG. 2 shows the fuse element of FIG. 1 after winding;

FIG. 3 shows a front view of a support member as used in one embodiment of the invention;

FIG. 4 shows a side view of the support member shown in FIG. 3;

FIG. 5 shows a support rod for use with the support members of FIGS. 3 and 4;

FIG. 6 shows a front view of a support member of another embodiment of the invention;

FIG. 7 shows a side view of the support member shown in FIG. 6;

Figure 8:
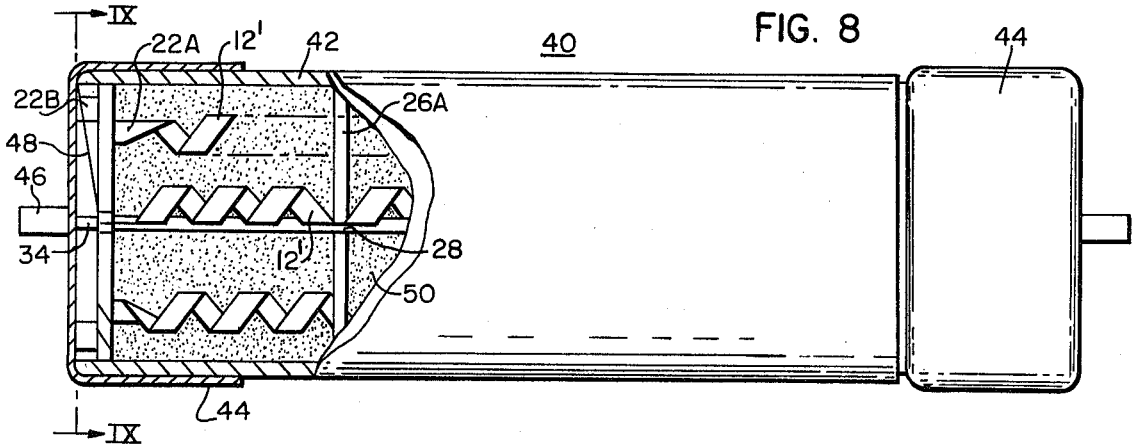
FIG. 8 shows a current limiting fuse in side elevation partially broken away to show the arrangement of the fuse elements therein.
Figure 9:
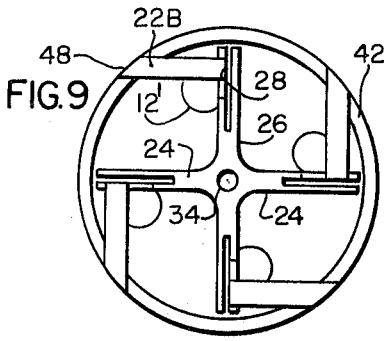
FIG. 9 shows a cross-sectional view of the fuse shown in FIG. 8 along the line IX—IX.
Figure 10:
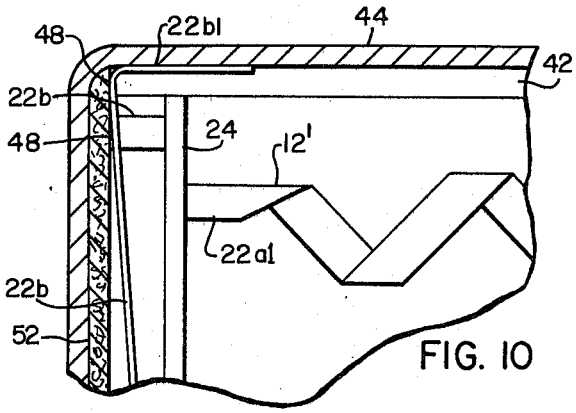

FIG. **9*a* shows another embodiment of the fuse construction shown in FIG. 8**;

FIG. **9*b*** shows still another embodiment of a support member;

FIG. **9*c* shows still another embodiment of a support member and fuse elements similar to that shown in FIG. 9**;

FIG. **9*d* shows still another embodiment of a support member and fuse elements similar to that shown in FIG. 9; and FIG. 10** shows an enlarged portion of a side elevation in section of a current limiting fuse with a special insulating disk contained therein.

DESCRIPTION OF THE PREFERRED EMBODIMENTS

Referring now to the drawings, and FIG. 1 in particular, an elongated current limiting fuse element 12 of the type having peripherally oppositely disposed V-shaped notches along an alongated section of fuse material 14 is shown. This fuse element is of the type which is useful as a winding, as shown in FIG. 2, to overcome one of the most severe problems associated with current limiting fuses, that is, to achieve low current interruption in a relatively high voltage current limiting fuse in a small fuse package or case where the elements have enough total cross-sectional area to carry high values of rated load current. Fuse element 12 may have a droplet of material 18 place on a planar portion therof which is useful in initiating the fusing operation during overload condition. This material may comprise an alloy of tin or silver. The fuse element 12 is shown having the elongated ends thereof bent away from the main body of the fuse element 14 in preparation for winding in a convoluted manner.

Referring now to FIG. 2, a wound fuse element 12' is shown. The V-shaped notches are deleted for purposes of clarity of illustration. It can be easily seen that the elongated fuse strip 14 is wound in a convenient spiral. The ends 22 and 20 which have been prebent, as shown in FIG. 1, now align longitudinally with the center line of the axis of the spiral of the fuse element 12'. The droplet or globule of arc starting material 18 is depicted. A fuse element 12' is of the type that permits the building of an economical high interrupting current limiting device with excellent low current clearing capability in a fuse package much smaller than heretofore possible in the prior art. As an example, a fuse element of this type may be useful in an 8.3 kilovolt 60 ampere fuse or in a 15.5 kilovolt 30–130 ampere fuse. It is to be understood that the previous values of voltage and current rating are not limiting in any way, but are merely examples of the capability of the fuse element shown in FIG. 2.

FIG. 3 shows a multi-armed support member, mandrel or spider 24. In this particular embodiment of the invention, support member 24 has four radial arms 26 extending from a central core or region 27. Radial arm 26 may be an elongated arm portion. A central opening or hole 30 is in the central region 27 ot accommodate a support rod. The arms are spaced at 90° intervals around the support member 27, and the material between adjacent arms has a radius of curvature 32.

Referring now to FIG. 4, a side view of the four armed fuse element support member 24, shown in FIG. 3, is depicted. The radial arms 26 are shown and in addition there is shown a slit or opening 28, also shown in FIG. 3, for supporting a portion of a fuse element such as 12' shown in FIG. 2.

FIG. 5 shows a support rod 34 which is conveniently arranged in the fuse so that the central opening 30 of spaced support members 24 may be positioned along the support rod 34. The support members 24 and the rod 34 are conveniently fastened together such as by epoxy gluing, both rod 34 and support members 24 may be insulating. The elements of FIGS. 1 through 5 have as exemplary dimensions the following values. The overall length of the fuse element 12 shown in FIG. 1 may be 30 inches. The diameter of the helix shown in FIG. 2 may be 0.315 inch. The support member of FIG. 3 may be 2.5 inches from the tip of one arm to the tip of the other arm and 1.25 inches from the center of hole 30 to the end of one arm. The width of one arm may be 0.188 inch, and the spacing of slit 28 may be 0.06 inch. The radius of curvature 32 may be 0.15 inch, and the distance between the center of hole 30 and the bottom of slit 28 may be 0.75 inch. Hole 30 may have a diameter of 0.141 inch. The length of rod 34 may vary depending on the size of the fuse from 9.5 inches to 17.51 inches. It is to be understood that none of the dimensions previously described are limiting.

Referring now to FIG. 6, there is shown another embodiment of the support member utilized in this invention. This embodiment, known as 24', comprises 8 radial arms spaced circumferentially at 45° angles from one another. The radial arms are generally designated 26' having slits 28' therein. There is a central hole 30', and the radius of curvature of the material between radial arms is indicated as 32'.

FIG. 7 shows a side view of the support member 24' including the showing of portions of five of the radial arms 26' and one central slit 28'. The foregoing member described in FIGS. 6 and 7 may have the following dimensions, which should not be interpreted as limiting in nature. The distance between tips of oppositely disposed radial arms may be 3.5 inches. The distance between the central hole 30' and the tip of a radial arm may be 1.75 inches. The width of each radial arm may be 0.25 inch and the dimension of the slit 28' may be 0.06 inch. The diameter of the central hole 30' may be 0.141 inch, and the radius of curvature 32' is 0.25 inch. The distance between the center of the central hole 30' and the bottom of any slit 28' may be 0.75 inch.

The support members shown in FIGS. 3, 4, 6 and 7 may comprise polyester sheet material, which is .125 inch thick.

Referring now to FIG. 8, a cutaway portion of an assembled fuse 40 is shown. Fuse 40 comprises a hollow, tubular, cylindrical, electrically insulating glass melamine or polyester housing 42 having an interior portion or central cavity 41 and opened ends. Fixedly attached to each end of the housing 42 are spaced ferrules or electrical conductors 44. Electrical conductors 44 have jutting from the central portion of each a tapped threaded portion 46. Shown disposed within the cutaway portion of the interior of the hollow tube 42 are four fuse elements 12', such as shown in FIG. 2 but not limited thereto. The fuse elements 12' have been stretched to provide openings between adjacent portions of the turns of the spiral shaped fuse elements. Two spacer members **26*a* and 26*b*, such as member 26 shown in FIG. 3, are shown disposed along a narrow rod 34, such as rod 34 shown in FIG. 5. Because of the parallel arrangement of the fuse elements 12', only three can be seen in the cutaway portion of FIG. 8. However, the fourth is disposed behind the middle one, as shown in FIG. 9. The spiraled fuse elements 12' are fastened at or secured at the slit or opening 28 in the spaced support members 26*a* and 26*b*. It will be noted that the coiled fuse elements hang suspended between radial arms and do not completely enclose the fuse members 26*a* and 26*b*. It will also be noted that because of this arrangement and because of the relatively small diameter of the helix, the spacing between parallel fuse elements is maintained at a rather large value. This tends to eliminate arc-over between parallel fuse elements or short circuiting between parallel fuse elements during the fusing operation. The spiraled fuse elements 12' may be secured to the slit member 28'** by use of an epoxy glue or other suitable securing means or may be held in place in the slits merely by the pressure of the fuse element against the side walls of the slits.

In another embodiment of the invention, the fuse element may be wound around a portion of one of the protruding members formed by the slit in the upper portion of arm **26*a* to provide a secure anchor for the suspended fuse elements 12'. This is better exemplified by reference to FIG. 9, which will be discussed hereinafter. Particular attention should be devoted to the end portion 22*a* of the uppermost fuse element whih is exemplary of all the end portions of the fuse elements of any or all of the fuses discussed with respect to the embodiments of this invention. One portion of the end of the fuse element designated 22a lies between the main body of the coiled or spiraled fuse 12' and a radial arm 26 of the endmost support member 24. The other portion of the fuse element 22b is taken to the outer casing and lapped thereover. This is accomplished for all of the fuse elements within the fuse housing and, consequently, when the ferrule 44 is applied to the housing 42, the ends of the fuse elements are placed in electrical contact with the inside portion of the ferrule, and are held securely between longitudinal portions of the fuse housing 42 and the ferrule 44**.

Refering now to FIG. 9, a cutaway portion of the fuse of FIG. 8 shown along lines IX—IX is depicted. It will be noted that in this embodiment of the invention, support member 24 is employed having four 90° spaced radial arms 26. The unique attachment of the coiled fuse element 12' to the fuse arm 26 in the region of the slit 28 is depicted in FIG. 9. The lapping construction for fuse end portion 22b is depicted clearly in four portions at 90° intervals around the view of FIG. 9.

Figure 9A:
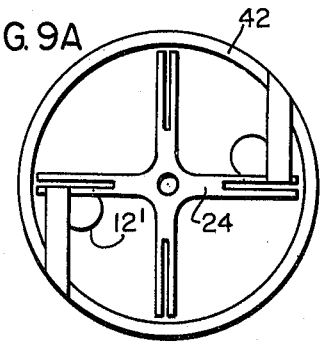

Referring now to FIG. 9A, another embodiment of the invention is depicted. In FIG. 9A, a four arm support member 24, such as shown in FIG. 3, is shown within cylindrical body 42. At two oppositely disposed radial arms two parallel fuse elements 12' are suspended. It will be noted that in FIG. 9 four parallel fuse elements 12' were suspended at 90° intervals around the fuse support member 24.

Figure 9B:
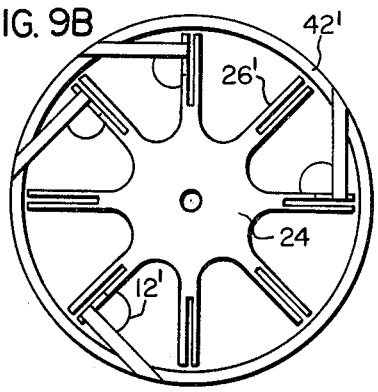
Figure 9C:
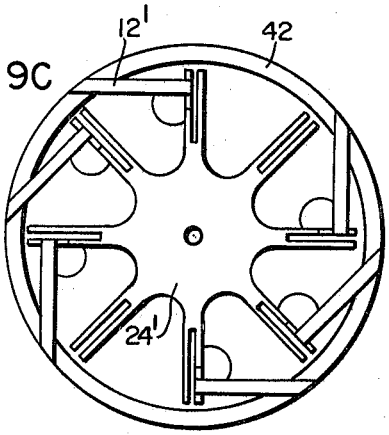
Figure 9D:
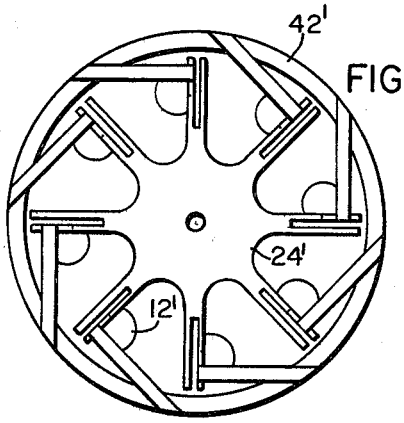

Referring now to FIGS. 9B through 9D, a larger diameter barrel 42' for a fuse is depicted. This barrel is adapted for use with support member 24' shown in FIGS. 6 and 7. This is the eight arm support member 24'. In FIG. 9B, four fuse elements are disposed in convenient relationship around the radial arms 26'. In FIG. 9C, an arrangement for disposing six fuse elements 12' in parallel around the supporter member 24' is shown. In FIG. 9D, eight fuse elements are disposed in parallel around the support member 24'.

Referring now to FIG. 10, another embodiment of the invention is shown. In FIG. 10, a portion of the end ferrule 44 and barrel or housing 42 is shown in assembled configuration. In addition, a fuse element 12' having end portions 22a1 attached to a support member 24 is shown. The end portion 22b corresponding to end portion 22a1 is shown extending outwardly in a convenient manner for lapping with the barrel 42. In a like manner, end portion 22b1 is shown extending generally transverse to end portion 22b, and is also shown lapping the barrel 42. With respect to end portion 22b1, it can be seen in this view how the ferrule 44 and the barrel end 42 act to compress the very endmost portion 22b1 between themselves. In this embodiment of the invention, an insulating disk 52 is provided between the end of the barrel 42 and the end of the ferrule 44. This design eliminates the need for expensive arcing contacts because the insulating disk, which may be asbestos, protects the inner surface of the end ferrule from arc impingement.

In the fuse embodiment shown in FIG. 8, a sand or quartz material, which may be otherwise known as a pulverulent arc quenching material 50, is depicted. This material completely surrounds all portions of each fuse element 12' to thereby assist in quenching arcs which develop in each of the fuse elements as the fusing operation occurs.

It is to be understood that the characteristic shapes of the support members shown in FIGS. 3 and 6, for example, are not limiting, and that offset center portions may be employed in the support member; the radial arms need not be evenly circumferentially spaced with respect to each other; they may be of differing lengths with respect to each other. It is also to be understood that the embodiments of this invention are not limited to arc-limiting fuse constructions. It is also to be understood that the absence or presence of the solder material 18, such as shown in FIGS. 1 and 2, is not limiting. It is also to be understood that the presence or absence of the pulverulent arc quenching material 50 is not limiting. It is also to be understood that the construction material used in the ferrules 44, the fuse housing body 42 and the fuse elements 12, 12' are not limiting. It is also to be understood that the pitch of the fuse element spiral need not be constant longitudinally nor in parallel sections. As an example, in one embodiment of the fuse element, five longitudinal spacers, such as 26, are used, with the pitch between the outermost spacers and the next innermost spacers being three full turns, and the pitch between the previously mentioned next innermost spacers to the central spacer being only two full turns. However, in other embodiments of the invention, the pitch or spacing may be maintained constant both longitudinally along a fuse element and with respect to parallel fuse elements. As an example, in one embodiment of the invention, nine support members, such as either 24 or 24' may be spaced evenly along the longitudinal length of the fuse with three full turns of each parallel fuse element being disposed between adjacent support members, therefore, providing 24 full turns along the entire length of the fuse. It is also to be understood that the wafers from which the support members are formed may be of gas evolving glass polyester so that They not only serve as supporting means for the fuse elements, but provide the gases which are sometimes necessary for low current interruption as well.

The apparatus embodying the teachings of this invention has many advantages. One advantage lies in the fact that all of the volume of sand is utilized efficiently because of the exposure of nearly all of the fusible material in any fuse element to sand for heat dissipation. Another advantage lies in the fact that the construction features of the invention eliminate or reduce the possibility of restrikes along the core, as there is no continuous path of core destruction upon interruption; and even in the very severe cases where the fulgurite formed by an interruption might impinge upon the support rod, a high alumina ceramic rod could be used to prevent restrikes. Another advantage lies in the fact that the spacing between parallel fuse elements is increased, thus increasing the high voltage operating characteristics of the fuse elements with respect to similar fuse elements of similar sizes and current ratings. Another advantage lies in the fact that an economy of material for the fuse elements may be realized because only radial arms, such as 26 and 26' shown in FIGS. 3 and 6, are necessary to support the fuse elements, and that a complete circumferential disk of material is not necessary. Another advantage lies in the fact that the disk 52 of FIG. 10 helps to eliminate arc impingement between the fuse elements and the ferrule or end terminal of a current limiting fuse.

What I claim as my invention is:

1. An electrical current limiting fuse, comprising:

(a) an electrically insulating tubular fuse housing;

(b) a pair of spaced electrically conducting ferrules disposed at either end of said tubular housing and communicating with the internal portion of said tubular housing, said ferrules being adapted to be connected in circuit relationship to a source of power and a load to be protected by said fuse;

(c) a fuse element support member disposed in said internal portion of said tubular fuse housing, said support member having an elongated arm portion with support means thereon for supporting a portion of a fuse element; and (d) a coiled fuse element electrically connected between said ferrules and disposed in said internal portion of said hollow tubular housing, said fuse element being supported at one portion thereof by said support means of said arm portion but not significantly enclosing said support member within the periphery of said coiled fuse element.

2. The combination as claimed in claim 1, comprising, pulverulent arc quenching material disposed within said external portion of said hollow tubular fuse housing for quenching an arc which may develop between portions of said fuse element during a fusing operation.

* * * * *